US006852972B2

(12) United States Patent
Baba et al.

(10) Patent No.: US 6,852,972 B2
(45) Date of Patent: Feb. 8, 2005

(54) MASS SPECTROMETER

(75) Inventors: Takashi Baba, Kawagoe (JP); Yuichiro Hashimoto, Kokubunji (JP); Kiyomi Yoshinari, Hitachi (JP)

(73) Assignee: Hitachi High-Technologies Corporation, Tokyo (JP)

( * ) Notice: Subject to any disclaimer, the term of this patent is extended or adjusted under 35 U.S.C. 154(b) by 0 days.

(21) Appl. No.: 10/446,667

(22) Filed: May 29, 2003

(65) Prior Publication Data

US 2003/0222214 A1 Dec. 4, 2003

(30) Foreign Application Priority Data

May 30, 2002 (JP) ..... 2002-156647

(51) Int. Cl.[7] ..... H01J 49/40

(52) U.S. Cl. ..... 250/292; 250/281; 250/282; 250/287; 250/288; 250/290

(58) Field of Search ..... 250/281, 282, 250/287, 288, 290, 292

(56) References Cited

U.S. PATENT DOCUMENTS 5,783,824 A * 7/1998 Baba et al. ..... 250/281
5,789,747 A * 8/1998 Kato et al. ..... 250/292
6,107,623 A * 8/2000 Bateman et al. ..... 250/282
6,121,607 A * 9/2000 Whitehouse et al. ..... 250/288
6,392,226 B1 * 5/2002 Takada et al. ..... 250/292
6,403,952 B2 * 6/2002 Whitehouse et al. ..... 250/288
6,541,769 B1 * 4/2003 Takada et al. ..... 250/290
6,576,893 B1 * 6/2003 Kawato et al. ..... 250/281
2002/0100870 A1 * 8/2002 Whitehouse et al. ..... 250/281
2003/0006370 A1 * 1/2003 Bateman et al. ..... 250/287
2003/0111595 A1 * 6/2003 Bateman et al. ..... 250/281
2003/0122070 A1 * 7/2003 Chang et al. ..... 250/292
2003/0132377 A1 * 7/2003 Bateman et al. ..... 250/281
2003/0160169 A1 * 8/2003 Baba et al. ..... 250/292
2003/0222214 A1 * 12/2003 Baba et al. ..... 250/292

OTHER PUBLICATIONS

"Practical Aspects of Ion Trap Mass Spectrometry", 1995, pp. 34–60.
"Time–of–Flight Mass Spectrometry", 1997, pp. 1–17.
Randy W. Purves and Liang Li; J.Am.Soc. Spectrom, 8(1997), pp. 1085–1093.
JP–A–2001–297730.
WO01/15201A2.

* cited by examiner

*Primary Examiner*—John R. Lee
*Assistant Examiner*—Bernard E. Souw
(74) *Attorney, Agent, or Firm*—Antonelli, Terry, Stout & Kraus, LLP

(57) ABSTRACT

Heavy ions are ejected earlier than light ions sequentially at almost zero energy and they are accelerated at a fixed voltage so as to be guided to a pusher of a TOF spectrometer. After ions are ejected in a procedure of giving an electric field gradient to an ion trap and linearly decreasing its RF voltage, a condition of spatially focusing ions having all mass numbers of a single point on the pusher is found. The focused ions are vertically accelerated using the pusher to perform the TOF mass spectrometry.

4 Claims, 10 Drawing Sheets

MASS SPECTROMETER

BACKGROUND OF THE INVENTION

After finishing the human DNA analysis, structure analysis of bio molecules such as proteins, which are based on the gentic information, enables to find and develop new drugs.

IT-TOFMS offers fast structure analysis means for this purpose.

A protein analysis requires a high mass resolution of 5,000 or more, a high mass accuracy of 10 ppm, and a high sensitive multistage mass spectrometry. IT-TOFMS which is comprising two parts; an ion trap (IT) and a time-of-flight mass spectrometer (TOFMS), is expected to satisfy these requirements, because it determines a molecular structure using dissociation reactions in the ion trap and high mass resolution and a high mass accuracy mass analysis in the TOFMS. A 3-D quadrupole ion trap, as a said IT, stores ions stably with a quadrupole high-frequency voltage. The following operation method is described in "Practical Aspects of Ion Trap Mass Spectrometry," R. E. March and F. J. Todd, John Wiley, 1995, page 34 to page 60. Sample ions are generated outside of the ion trap and trapped inside thereof. For the purpose the ion trap is filled with helium or other gas of several to several tens of m Torr. Incident ions are cooled by a collision with the gas and stored in the ion trap. The ion trap enables a removal of contaminations, a collision induced dissociation (CID) with the gas filling the ion trap, chemical reactions with the gas, or photochemical reactions. By detecting mass spectra after the dissociation as well as before that (multistage mass spectrometry), structure of the sample ions can be analyzed. Present mass spectrometers using Ion trap, however, is incapable of sufficiently achieving a resolution and a mass accuracy necessary for a protein analysis.

The following TOFMS operating method is described in "Time-of-Flight Mass Spectrometry," R. J. Cotter, ACS professional reference book, 1997, page 1 to page 17. As shown in FIG. 6, the TOFMS comprises a pusher and an ion detector.

The pusher is an accelerator, which is composed of parallel plates and is applied high voltage pulses.

The plates are perforated or meshed so as to enable ions to pass through them. The ions accelerated by the pusher fly toward the ion detector. A multi channel plate (or MCP) is used for the detector. A flying time between the pusher and the MCP is measured. Since a distance between the pusher and the MCP and kinetic energy of ions are known, the mass of ions can be calculated. Furthermore, a reflectron is often used to get a high mass resolution because it corrects a spatial and energetic spread of ions in the pusher that decreases the mass resolution. The above method, however, is incapable of performing the multistage mass spectrometry and therefore structure analysis is difficult.

The following two conventional IT-TOFMS methods are well known as those with a combination of the ion trap and the TOF mass spectrometer. One is a coaxial-accelerator analyzer, which is well known in the literature, R. W. Purves and Liang Li: J. Am. Soc. Spectrom. 8 (1997), page 1,085 to page 1,093. In this prior art, the ion trap operates as a pusher as well as a trapping device. In other words, ions are accelerated by applying an voltage between two endcaps almost simultaneously with turning off an RF voltage applied to a ring voltage. The accelerated ions are ejected from a hole opened in the center of the endcap, and the ion detector located on an extension detects the ions. This method has an advantage that its configuration is simple. In the above method, however, the mass resolution and the mass accuracy were not good for ions having high mass numbers because of collision between the ions and the bath gas.

The other example of the IT-TOF MS is described in Japanese Unexamined Patent Publication (Kokai) No. 2001-297730. According to this, ions ejected from the ion trap are accelerated in a direction orthogonal to the traveling direction in a high vacuum unit. By spatial and energetic focusing by using ion focusing mechanism before accelerating the ions in the orthogonal direction, a high mass resolution and a high mass accuracy are achieved. The above method, however, causes another problem of a narrow mass range of ions detectable at a single pushing called mass window.

In other words, an operation of ejecting ions from the ion trap and pushing TOF is a mass separation. In other words, light ions arrive at the pusher earlier and heavy ions arrive later. Because the pusher size is limited, there is a mass range of ions pushable at a single ion ejection. Assuming that $z_0$ is a distance from the center of the ion trap to the endcap, L is a distance from there to an entrance of the pusher, I is a pusher length, V is an acceleration voltage, $m_1$ is the minimum ion mass number analyzable, and $m_2$ is the maximum ion mass number analyzable, an analyzable mass-to-charge ratio, in other words, the mass window is given by:

$$m_2/m_1=\{(L+1+2z_0)/(L+2z_0)\}^2$$

Thereby, the mass window is substantially around 2. For example, a range of mass numbers 200 to 400 or 400 to 800 is a mass range of ions analyzable at a time. Therefore, to measure ions of mass numbers 200 to 4,000, the measurement need be performed five. Although these measurements can be performed in parallel, it decreases a throughput, which significantly reduces sensitivity. Therefore, desirably the mass window is equal to or more than 20.

SUMMARY OF THE INVENTION

The present invention discloses an operating method for ion trap TOF mass spectrometry with a wide mass window.

The mass window problem in the prior art disclosed in Japanese Unexamined Patent Publication (Kokai) No. 2001-297730 is caused by that all ions are ejected simultaneously at the center of the ion trap. By using an operating method in which heavy ions are ejected earlier than light ions, ions of all mass numbers can be focused at a single point on the pusher. In other words, ions are sequentially ejected in descending order of weight at low energy from an opening of the endcap of the ion trap, and they are accelerated. While the heavy ions are flying in a drift region, light ions are ejected from the ion trap at a certain timing and accelerated. Thereafter, when the heavy ions arrive at the pusher, the light ions just get to arrive at the pusher.

Other objects, features and advantages of the invention will become apparent from the following description of the embodiments of the invention taken in conjunction with the accompanying drawings.

DETAILED DESCRIPTION OF THE EMBODIMENTS

A hole is made on a 3-D quadrupole ion trap so as to eject ions from the ion trap, and therefore even an electrode formed by an ideal hyperboloid of revolution does not always generate an ideal quadrupole electric field inside. To correct it, the electrode is sometimes deformed. While it is described as a quadrupole electric field in the specification of the present invention as a matter of for convenience, it should be understood that the description includes deformed quadrupole electric fields or electrodes.

Figure 1:
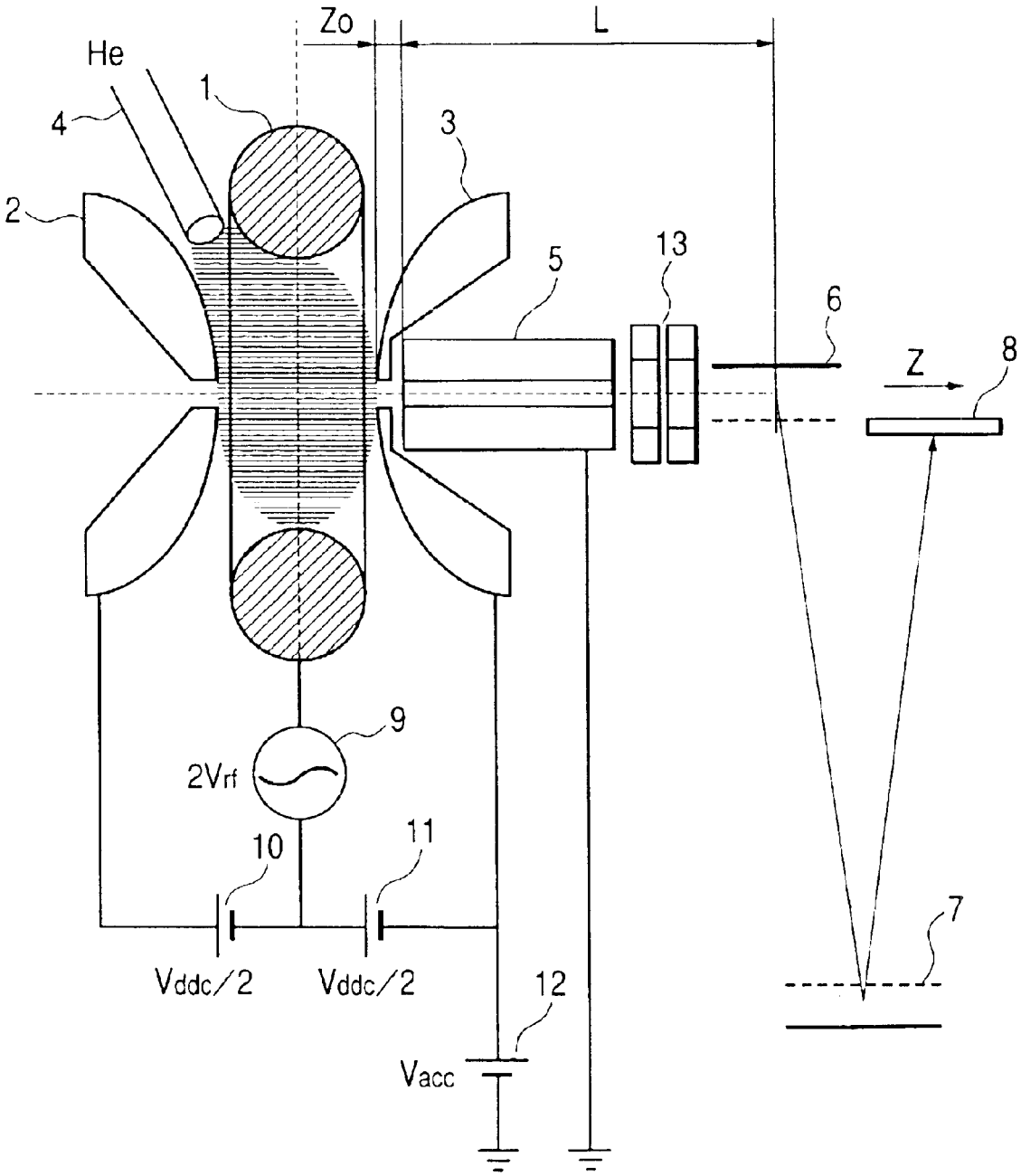
FIG. 1 is a diagram schematically showing a configuration of an apparatus according to a first embodiment of the present invention.
Figure 4A:
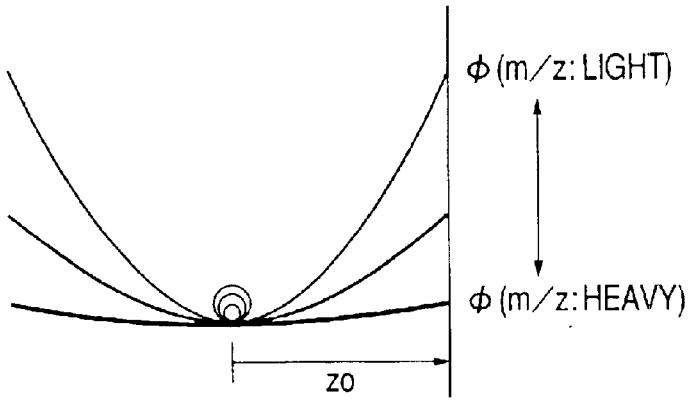
FIGS. 4A to 4C are diagrams showing a principle of ejecting heavy ions earlier.
Figure 4B:
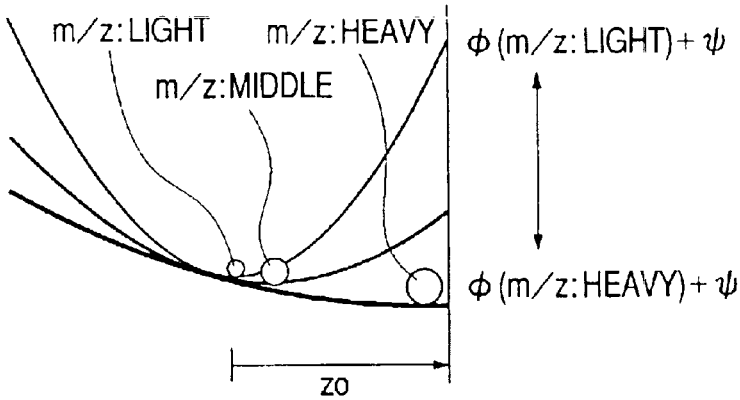
Figure 4C:
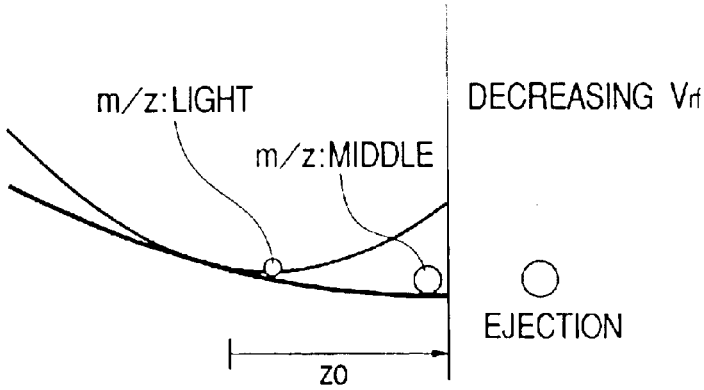
Figure 5:
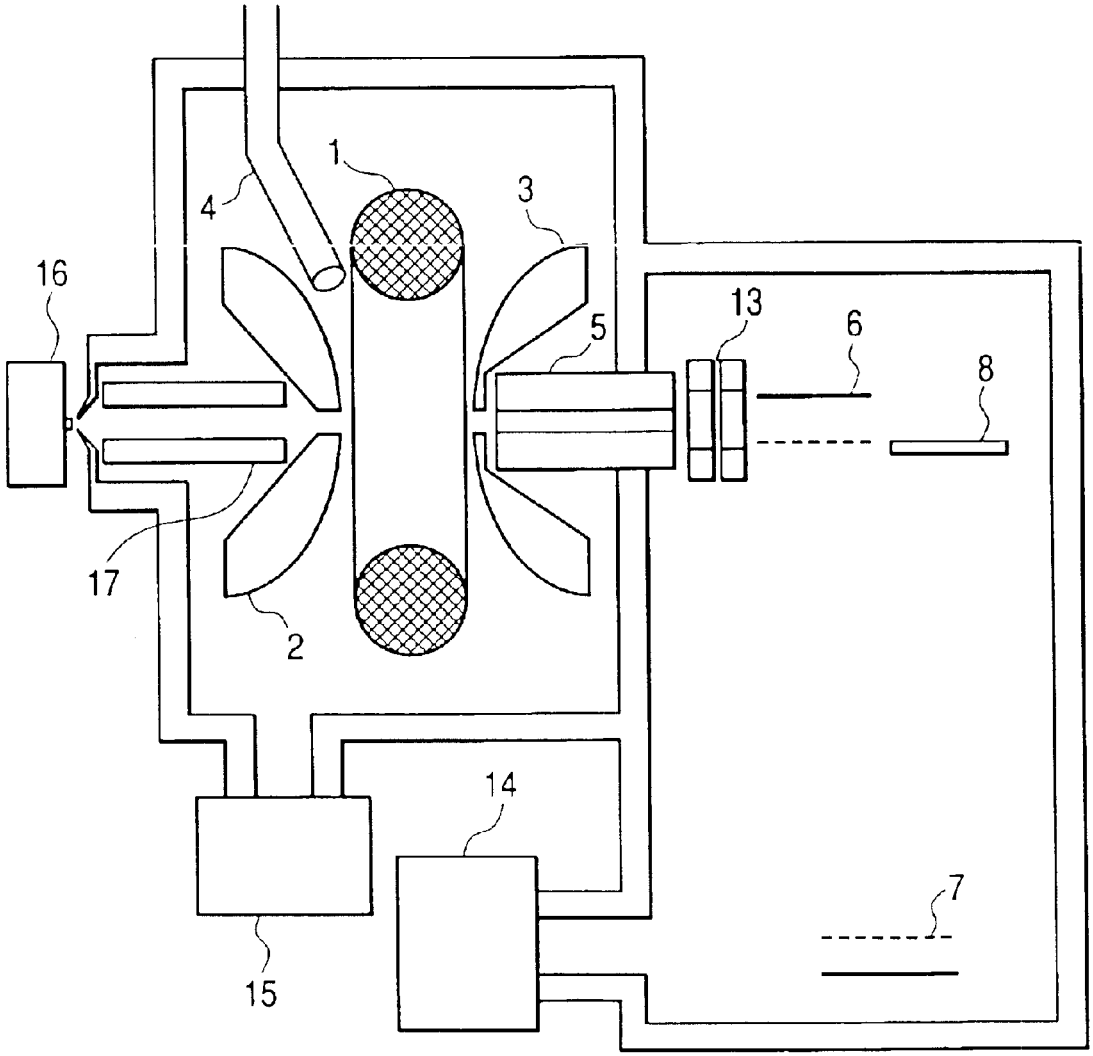
FIG. 5 is a schematic diagram showing the entire configuration of the apparatus when the present invention is put into practice.
Figure 6:
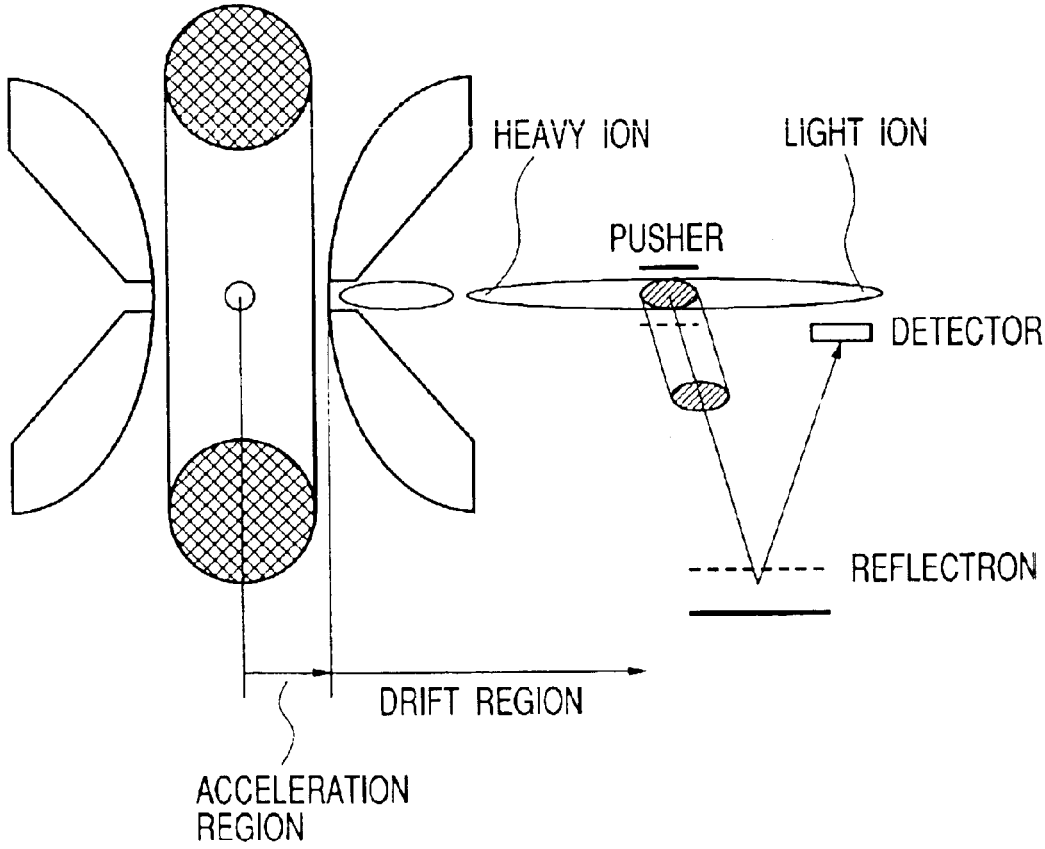
FIG. 6 is an explanatory diagram showing a conventional technology.

FIGS. 1 and 5 show diagrams of the first embodiment. The apparatus comprises of a 3-D quadrupole ion trap (reference numerals 1 to 3 in the diagram), a drift region (5), and an orthogonal acceleration TOF mass spectrometer (6, 7, and 8). By orthogonalizing the direction in which ions are introduced from the ion trap to the TOF with the direction of the TOF pushing (at 70° to 110°), the mass resolution and the mass accuracy are achieved. Furthermore, as shown in FIG. 5, the above portions are stored in a vacuum chamber. An ion trap chamber and a TOF chamber are evacuated with vacuum pumps (14 and 15). Ions generated by an ion source (16) pass through an ion guide (17). The first embodiment is characterized in a configuration by that the acceleration region after ejecting ions is negligibly short in comparison with the drift region. The ejected ions are accelerated by an electrostatic voltage $V_{acc}$ applied between an endcap (3) and a drift region (6). The ions generated by the ion source are injected from an opening of an endcap 2 and stored in the ion trap. Isolation and reactions are performed in the trap. These operations are called multistage mass spectrometry ($MS^n$). In a protein analysis or other fields, the mass accuracy of generated ions is insufficient only using the ion trap as a mass spectrometer, and therefore it is preferably combined with an orthogonal acceleration time-of-flight mass spectrometer (TOFMS) capable of achieving a high mass accuracy. The present invention relates to a procedure from an ion ejection from the ion trap to an execution of the mass spectrometry. The apparatus comprises the ion trap, the acceleration region, the drift region, and the TOF mass spectrometer. Referring to FIGS. 4A–4C, there is shown a diagram for a principle of the ion ejection from the ion trap. A potential for trapping ions is shown in FIG. 4A. The higher the mass number is, the shallower the potential is. Applying an electrostatic field changes the potential as shown in FIG. 4B, where ions having higher mass numbers vary more significantly in the z direction. Thereafter, by decreasing the trap potential as shown in FIG. 4C, ions can be ejected sequentially in descending order of mass from the ion trap at low energy. Ions are emitted from the vicinity of the minimum value of the potential, by which ions are ejected within a narrow range of energy. Bath gas is introduced into the ion trap, so that the ion trap pressure is kept around $10^{-2}$ Torr. The ion trap vacuum chamber outside the ion trap is kept at $10^{-3}$ Torr or lower vacuum and the TOFMS is kept at around $10^{-6}$ to $10^{-7}$ Torr vacuum.

Hereinafter a condition for focusing all ions with different mass numbers at a point is derived. In the 3-D quadrupole ion trap (FIG. 1), the quadrupole potential in the z direction is expressed by (Eq. 1):

$$\Phi(z) = \frac{z^2}{z_0^2} V_{rf} \cos(\Omega t) \quad \text{(Eq. 1)}$$

where the center of the ion trap is at potential zero. In this condition, a parameter q, a secular motion frequency (ω), and a pseudo potential (ϕ) are expressed by (Eq. 2), (Eq. 3), (Eq. 4), and (Eq. 5), respectively, as follows:

$$q = \frac{4eV_{rf}}{mz_0^2\Omega^2} \quad \text{(Eq. 2)}$$

$$\overline{D} = \frac{qD}{8} \quad \text{(Eq. 3)}$$

$$\omega = \frac{q\Omega}{2\sqrt{2}} \quad \text{(Eq. 4)}$$

$$\Phi(z) = \overline{D}\frac{z^2}{z_0^2} \quad \text{(Eq. 5)}$$

In the z direction of the ion trap, a linear potential gradient given by (Eq. 6) is applied:

$$\Psi(z) = -\frac{V_{ddc}}{2}\frac{z}{z_0} \quad \text{(Eq. 6)}$$

A composite potential of the pseudo potential and the potential gradient is given by (Eq. 7):

$$\Phi(z) + \Psi(z) = \overline{D}\frac{z^2}{z_0^2} - \frac{V_{ddc}}{2}\frac{z}{z_0} \quad \text{(Eq. 7)}$$

A location at which the minimum value of the potential is given is obtained by (Eq. 8):

$$Z_{\min} = \frac{mz_0^3}{4eV_{rf}^2} V_{ddc}\Omega^2 \quad \text{(Eq. 8)}$$

A threshold at which ions are ejected by the electric field gradient is achieved when $Z_{min}=Z_0$, and therefore a high-frequency amplitude at an ejection of ions having the mass number m is given by (Eq. 9):

$$V_{rf}^2 = \frac{m}{e} z_0^2 \Omega^2 \frac{V_{ddc}}{4} \quad \text{(Eq. 9)}$$

On the other hand, the time period during which ions accelerated at $V_{acc}$ fly only a distance L is given by (Eq. 10):

$$t = L\sqrt{\frac{m}{2eV_{acc}}} \quad \text{(Eq. 10)}$$

By using this equation, a start time for focusing ions having an arbitrary mass number m at the distance L is obtained by (Eq. 11):

$$t = \frac{L}{\sqrt{2eV_{acc}}}\left(\sqrt{m_{\max}} - \sqrt{m}\right) \quad \text{(Eq. 11)}$$

where $m_{max}$ is the maximum mass-to-charge ratio at which ions can be trapped at an initial value $V_{rf0}$ of a high-frequency voltage when the electric field gradient is given and it is given by (Eq. 12):

$$m_{\max} = \frac{4V_{rf0}^2}{z_0^2 \Omega^2 V_{ddc}} \quad \text{(Eq. 12)}$$

According to (Eq. 9) and (Eq. 11), a dependence on the time for sweeping the RF amplitude so as to focus any ions on a single point can be given by (Eq. 13) and (Eq. 14):

$$V_{rf}(t) = V_{rf0}\left(1 - \frac{t}{t_{scan}}\right) \quad \text{(Eq. 13)}$$

$$t_{scan} = \sqrt{\frac{2V_{rf0}^2}{V_{acc}V_{ddc}}}\,\frac{L}{z_0\Omega} \quad \text{(Eq. 14)}$$

As shown in (Eq. 13), the high-frequency amplitude should be simply decreased linearly in order to focus the ions on a single point. In this connection, at the moment an envelope of the RF amplitude reaches zero at time $t=t_{scan}$. Therefore, a simple relation is obtained such that the acceleration should be started at the time $t=t_{scan}$ when the ions are focused in order to accelerate the ions most efficiently.

Now the following describes the consideration of a mass range of ions analyzable at a single ejection from the ion trap. The maximum analyzable mass number is given by (Eq. 12). On the other hand, the minimum analyzable mass number is defined in a stable region (q<0.908) of the ion trap and is given by (Eq. 15):

$$m_{\min} = \frac{4}{0.908}\frac{V_{rf0}}{z_0^2\Omega^2} \quad \text{(Eq. 15)}$$

The mass window giving the mass range of ions mass-analyzable at a single ejection from the ion trap can be evaluated by (Eq. 16):

$$m_{\max}/m_{\min} = 0.908\frac{V_{rf}}{V_{ddc}} \quad \text{(Eq. 16)}$$

From (Eq. 14), L can be decreased by decreasing $t_{scan}$, thereby reducing the apparatus in size. Preferably $t_{scan}$<10 ms in view of the practical apparatus size. There is a problem that, however, if $t_{scan}$ is too small, ions cannot follow the shift of the minimum value of the potential and the ions are not ejected from the ion trap at a correct timing. A resonant frequency inside the ion trap is tens to hundreds of kHz and therefore preferably $t_{scan}$>10 ms.

Figure 2:
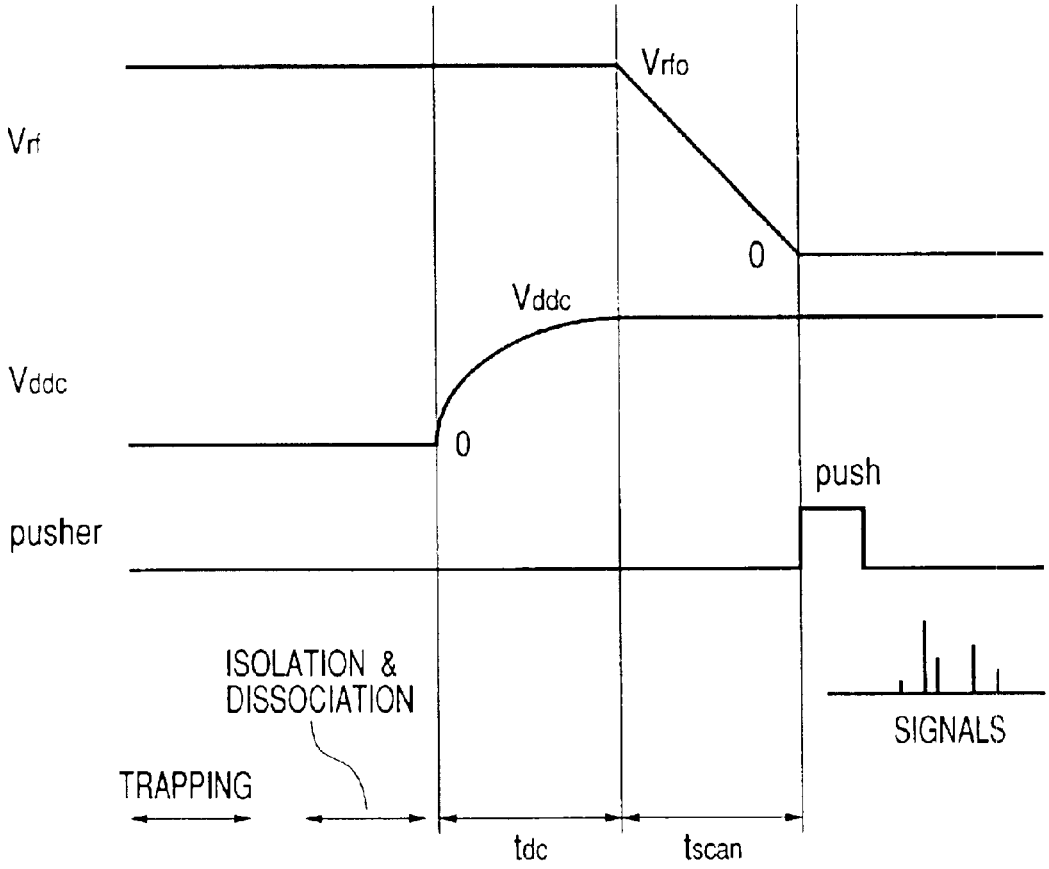
FIG. 2 is a diagram schematically showing an operation procedure according to the first embodiment of the present invention.

An operation procedure of the present invention is shown in FIG. 2. Ions generated by the ion source are trapped in the ion trap. After a completion of the trapping, the ion isolation, ion decomposition, and other operations are performed. Thereafter, the electrostatic voltage $V_{ddc}$ is applied to a portion between the endcap electrodes. In this operation, the electrostatic voltage is preferably increased to the given value $V_{ddc}$, taking time of approx. 0.1 ms or longer. Otherwise, heavy ions are lost in the ion trap at this time, by which a sufficient mass window cannot be obtained problematically. It is because the resonant frequency of ions in the trap is about tens to hundreds of kHz and a resonant instability of ions may occur unless the variation occurs over a period of time sufficiently longer than the period of the frequency. In other words, ions are stable if $V_{ddc}$ is increased over 0.1 ms or longer. After applying the electrostatic voltage to the given $V_{ddc}$, the high-frequency voltage is linearly decreased toward zero. The sweep time $t_{scan}$ is given by (Eq. 14). At the same time when the high-frequency amplitude becomes substantially zero, the pusher is activated. The pushed ions have kinetic energy of $eV_{acc}$ coaxially with the ion trap and kinetic energy of $eV_{push}$ in a direction perpendicular to it. There is a well-known design of an ion optical system in which ions reaches the MCP (8) via the reflectron (7) under these conditions. In other words, when $L_{TOF}$ is given a distance between the axis on an extension of the ion trap and the reflectron and D is a distance between the center of the pusher and that of the MCP, the MCP can be installed as given by (Eq. 17):

$$\sqrt{\frac{V_{acc}}{V_{push}}} = \frac{D}{2L_{TOF}} \quad \text{(Eq. 17)}$$

Figure 7:
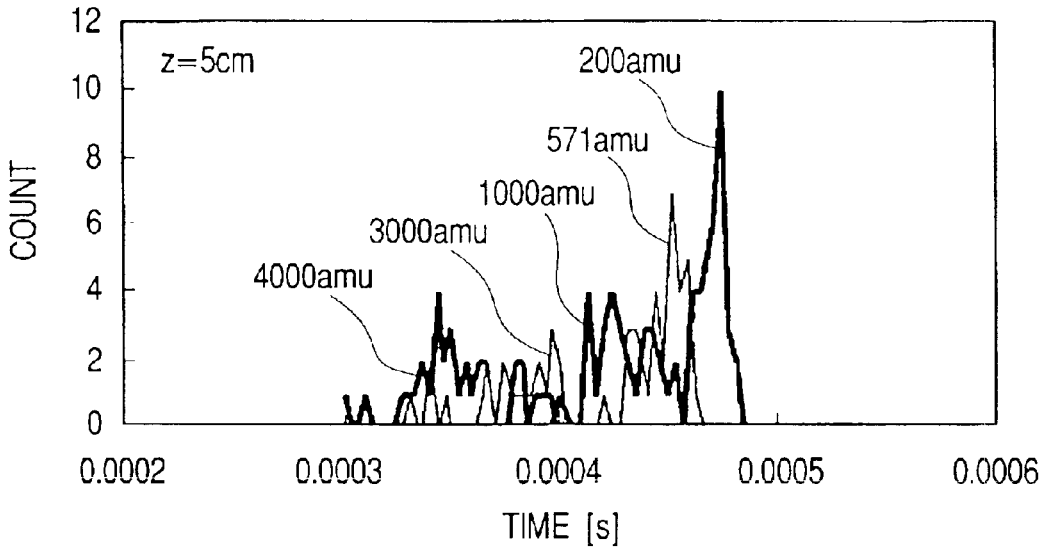
FIG. 7 is an explanatory diagram showing an effect of the present method.
Figure 8:
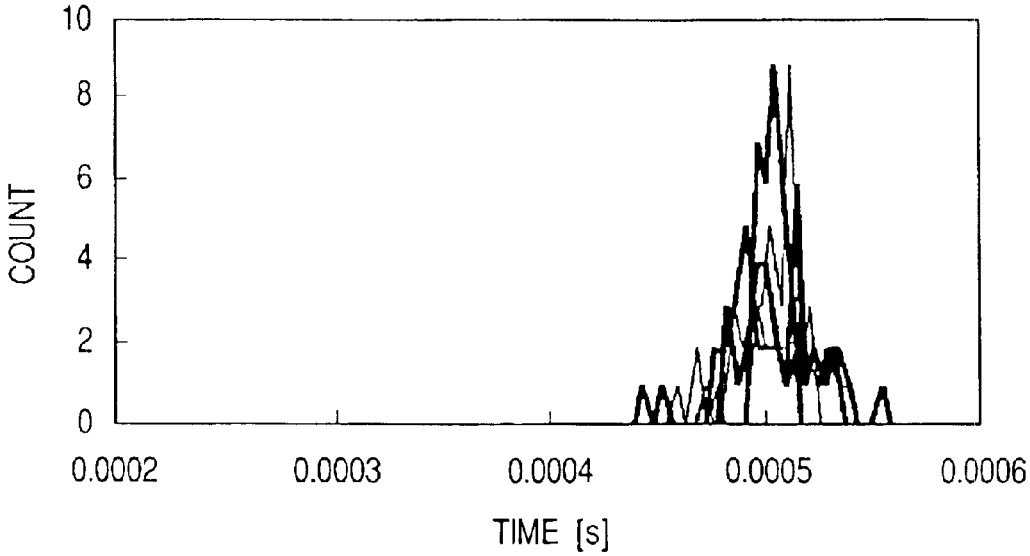
FIG. 8 is an explanatory diagram showing an effect of the present method.
Figure 9:
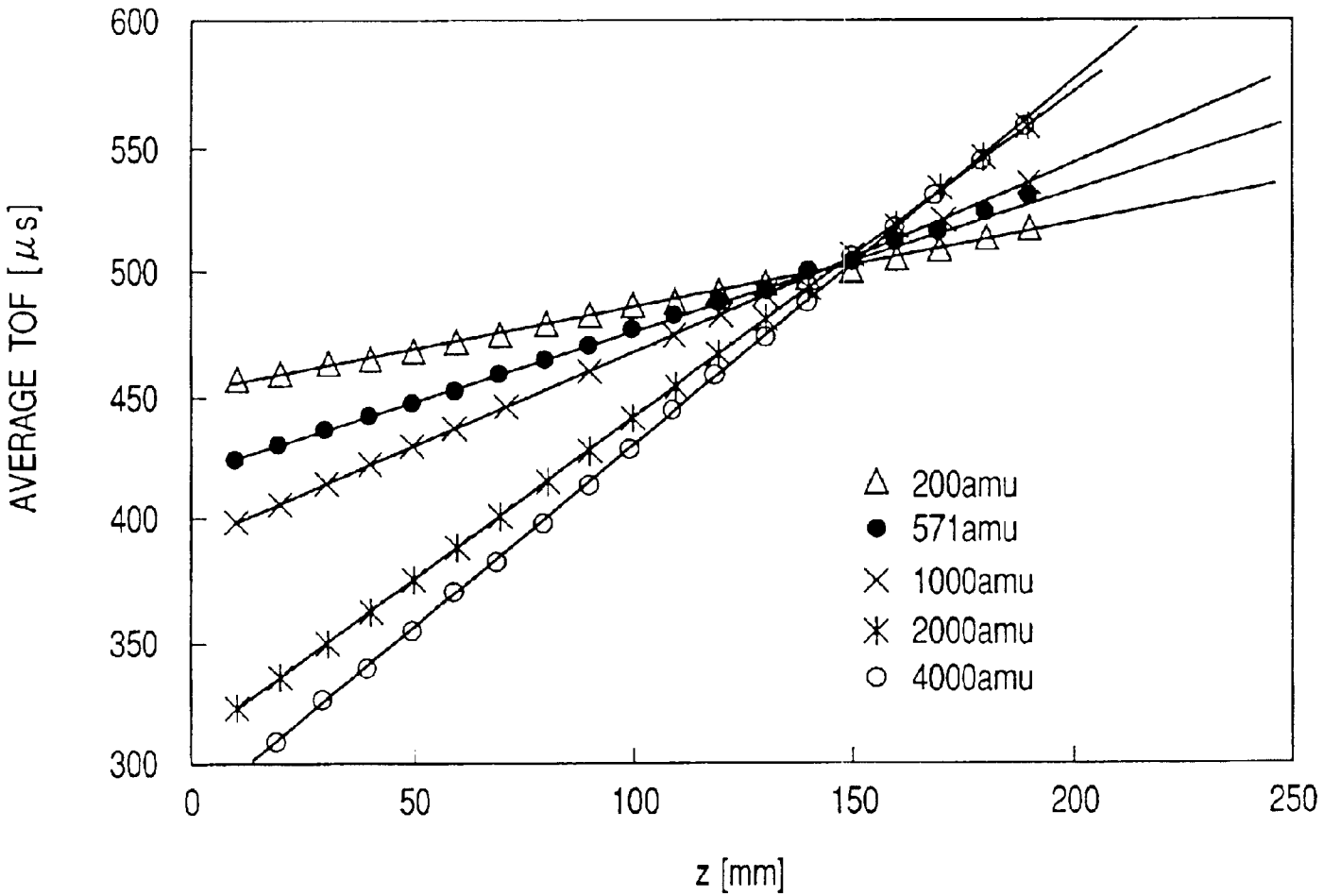
FIG. 9 is an explanatory diagram showing an effect of the present method.
Figure 10A:
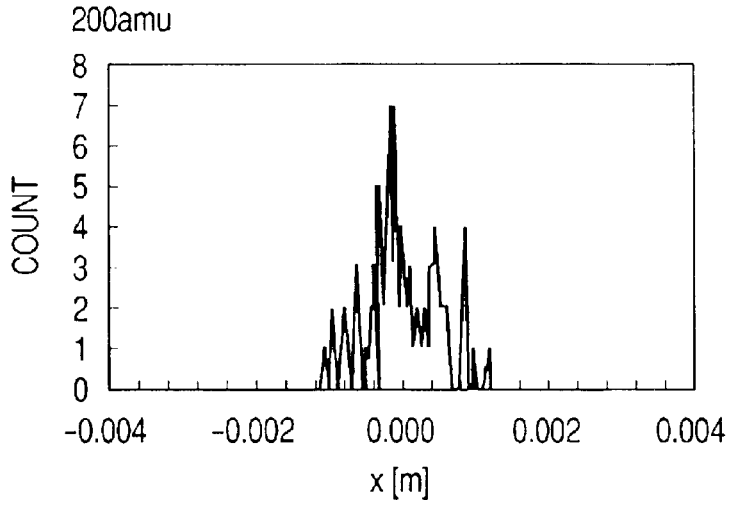
FIGS. 10A to 10C are explanatory diagrams showing an effect of the present method.
Figure 10B:
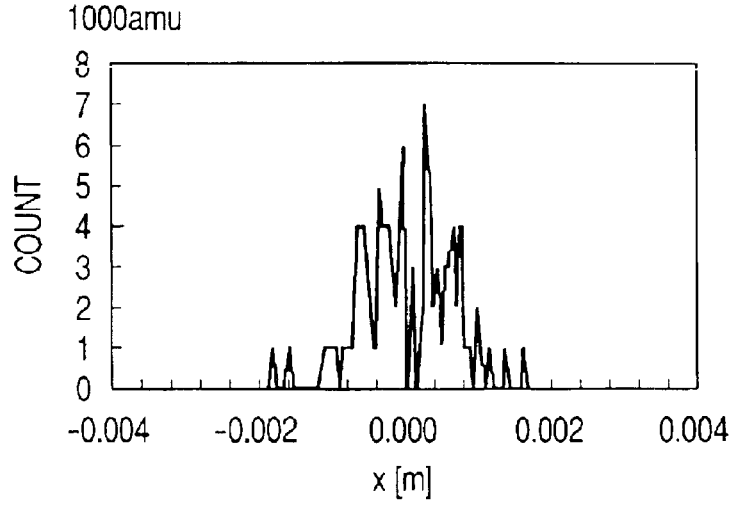
Figure 10C:
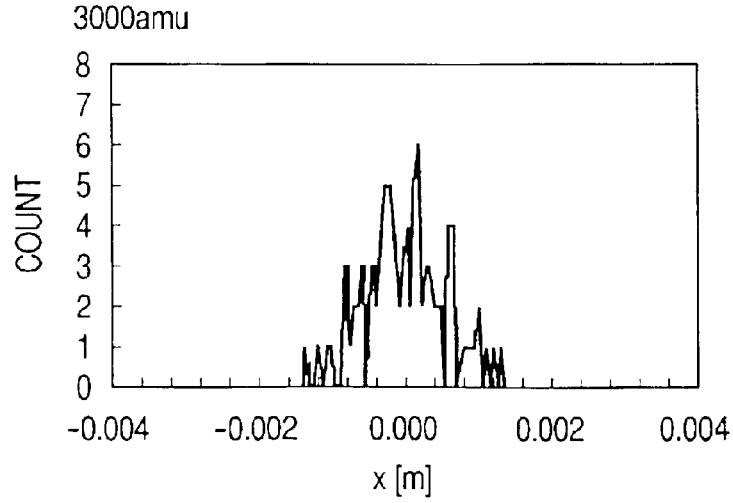
Figure 11:
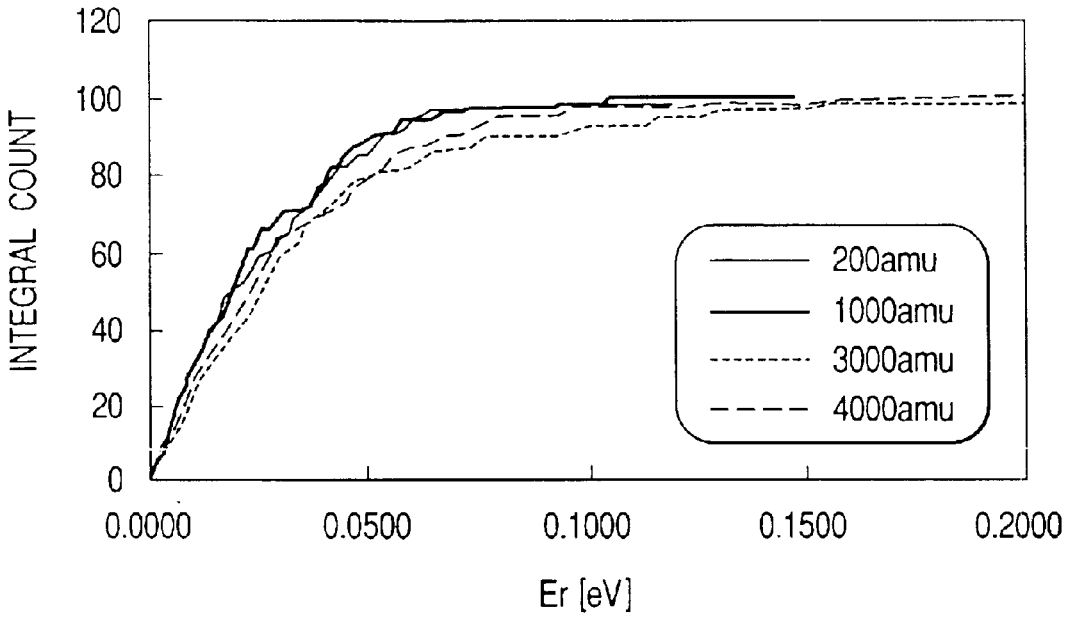
FIG. 11 is an explanatory diagram showing an effect of the present method.

The following describes a result of demonstrating the present method in a Monte Carlo simulation on the basis of consideration of a collision with the gas. As design parameters, an ion trap size z0, an ion trap frequency, and an ion trap high-frequency amplitude are assumed to be 5 mm, 770 kHz, and 250 V, respectively. Furthermore, $V_{ddc}$, $V_{acc}$, and $t_{scan}$ are assumed 2 V, 10 V, and 500 ms, respectively, and a distance L between the ion trap endcap and the center of the pusher (a drift distance) is assumed 0.15 m. The He gas pressure in the ion trap is assumed to be $10^{-2}$ Torr and an assumption is made to have an elastic collision model in which a collision cross-section of the ions is in proportion to the cube of the mass number. Referring to FIG. 7, there is shown an arrival time distribution of ions having mass numbers 200 to 4,000 at the point of 50 mm from the ion trap (z=50 mm). The zero point of the ion arrival time shows the time when the high-frequency amplitude starts to decrease linearly. At this point, ions having high mass numbers emitted earlier arrive there. On the other hand, FIG. 8 shows the ion arrival time distribution at a focal point (z=150 mm). It is understood that the ions having the mass numbers 200 to 4,000 focus at this point almost at the same time. FIG. 9 shows an average value of the ion arrival time at each point. As shown here, ions having different mass numbers focus at a single point. Referring to FIGS. 10A, 10B, and 10C, there are shown r coordinate distributions of ions ejected from the ion trap. It is understood that 80% ions can penetrate with a hole of 2 mmϕ or so on the ion trap. FIG. 11, shows an energy distribution of ions ejected from the ion trap in the r direction in the pusher. In detection with an orthogonal acceleration TOFMS, the energy distribution in the r direction is an important factor to determine the resolution. To obtain the resolution, it is preferable to restrain the energy to 50 meV or lower though it depends upon the TOF configuration: 80% ions are contained in it. In this simulation, all data of ions emitted from the ion trap is collected. It is possible to remove high-energy ions by making a slit in the middle. As a result of the above, it has been proved that the ions having mass numbers 200 to 4,000 can be measured in the TOF analysis with a single ejection from the ion trap.

To implement the operation of the present invention as an apparatus, the matters of the following disclosure are adopted, if necessary. Two types of electrostatic voltage applied to the ion trap, in other words, the voltage to the endcap electrodes for applying the electric field gradient and the voltage for applying the acceleration voltage do not require a high speed. Therefore, after each ion trap electrode is insulated in direct current by using a capacitor having a sufficiently greater value than that of a capacitance of the ion trap electrode, each electrode needs only be connected to a constant-voltage power supply that can be turned on or off via a resistance of 1 megohm or so.

The ions are accelerated between the acceleration voltage and the ground voltage applied to the ion trap when they are ejected from the ion outlet of the ion trap. In this embodiment, the ground electrode having a hole that the ions pass through is installed in close proximity to the opening of the ion trap. Therefore, the hole on the ion trap endcap and the hole on the ground metal plate form an electron lens. Its effect on ion focusing on the pusher depends upon conditions such as the acceleration voltage $V_{acc}$ and the distance from the pusher. Furthermore, each hole can be covered with fine metal mesh having a high open area ratio. It has an effect of improving the mass resolution of the TOF mass spectrometer since the electric field is shaped though the metal mesh decreases the ion transmittance. Preferably the ion flight region of the drift region is electrically shielded so as to prevent an accidental force from acting on ions to expand the space distribution in the pusher. A grounded metal tube (5) is installed. In the installation, if the inlet portion of the metal tube serves as the ground electrode of the acceleration region, the inlet is covered with fine metal mesh, thereby eliminating a lens effect caused by an electric field distortion.

It is effective to improve the mass resolution that a static lens (13) is arranged between an end of the drift region and the pusher so as to narrow the space and energy distribution in the acceleration direction in the pusher. In order to narrow the ion position and energy distribution in the acceleration direction, it is considered effective to introduce a quadrupole static lens capable of focusing in an arbitrary direction. Particularly, a combination of two quadrupole static lenses is effective. A beam is intensively focused in the acceleration direction with a first quadrupole static lens and then it is weakly dissipated in the acceleration direction with a second quadrupole static lens, thereby intensively narrowing down the beam in the acceleration direction. Although the potential energy distribution other than in the acceleration direction expands instead, it does not affect the resolution. Note that the static lens does not have any aberration caused by mass at the same ion kinetic energy and therefore it is unnecessary to change the applied voltage to the static lens corresponding to the mass of the passing ions.

Generally the TOF mass spectrometer is held in a higher vacuum than in the ion trap and therefore they are arranged in different vacuum chambers with a hole which ions pass through provided between them. In this embodiment, a vacuum chamber wall is located at an chamber is formed from a metal and grounded. Therefore, it has no problem in continuity or unity with the metal tube forming the drift region. In order to prevent approx. 1 V of a potential difference that may occur when a different-type metal is connected, in other words, a contact potential difference, the vacuum chamber and the metal tube are preferably of the same metal type and they are in direct contact with each other. Alternatively, it is effective to keep a uniformity of the metal type along the drift region by arranging the metal tube in such a way that it runs through the partition.

In the same manner, particularly to prevent an effect on a motion of ions in the vicinity of the outlet for ions provided at the endcap having small ion kinetic energy, the surface material of the metal mesh spread inside and outside the ion trap at the outlet should be the same as the surface material of the ion trap. For example, if the ion trap is plated with gold, the mesh is plated with gold, too. For example, if the ion trap is formed from stainless steel and its surface is kept to be stainless as it is, the mesh should be formed from the same stainless material having the same composition and they are directly joined.

Figure 3:
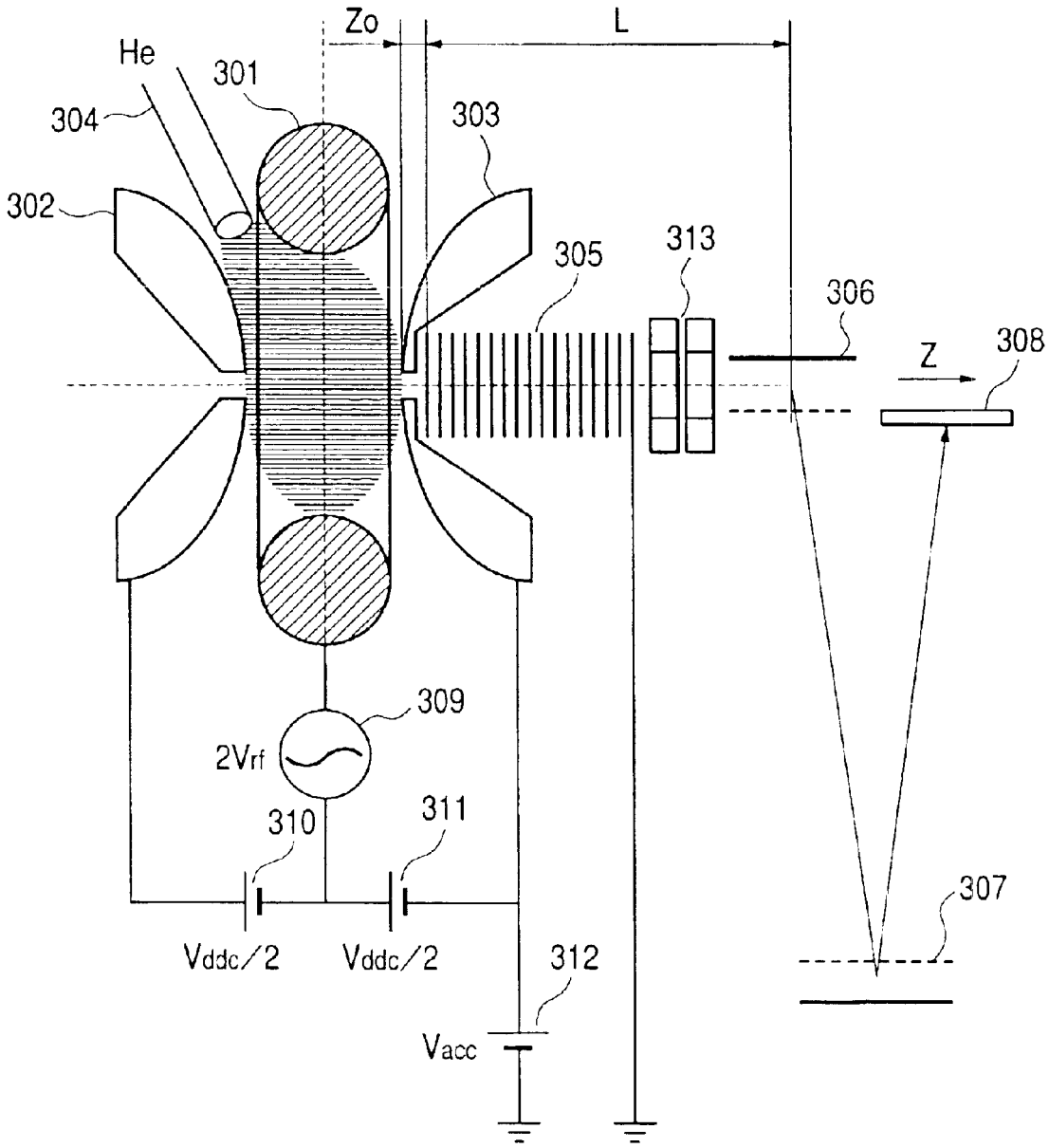
FIG. 3 is a diagram schematically showing a configuration of an apparatus according to a second embodiment of the present invention.

FIG. 3 shows a second embodiment. The second embodiment is characterized by that a distance between first embodiment by elongating the acceleration region from the ion trap to the TOFMS. The application to this embodiment only requires a replacement of the distance L between the ion trap and the center of the pusher, which has been used in the analytic discussion of the principle of ejecting ions in the first embodiment, with $2L_{acc}+L$. It is assumed again here that $L_{acc}$ is a length of the acceleration region and that L is a distance between the outlet of the acceleration region and the center of the pusher (drift region). If a small value is assigned to L and the same operating parameters as for the first embodiment are used, the distance between the ion trap and the TOF spectrometer can be reduced to around a half due to the coefficient 2 attached to $L_{acc}$. Other principles and effects of the second embodiment are the same as in the first embodiment.

A difference between the first and second embodiments in the above is an acceleration method of ions ejected from the ion trap. In the first embodiment, ions are accelerated immediately after the ions are ejected from the ion trap and the ions are drifted at a uniform velocity toward the pusher the distance L away. In the second embodiment, ions are accelerated in the acceleration region having a length of several tens of millimeters or longer immediately after the ions are ejected from the ion trap and the for drifting. In the second embodiment, it is possible to reduce the distance between the ion trap and the TOF mass spectrometer in comparison with the first embodiment. This makes it possible to reduce the entire apparatus in size.

To implement the above operation principle in an apparatus practically, as shown in FIG. 3, a multistage metal plate 305 is arranged so that the acceleration unit has a parallel electric field gradient so as to obtain a more ideal parallel electric field. Distortion, if any, spreads the ion spatial distribution, thereby decreasing the mass resolution of the TOF mass spectrometer. The parallel electric field is secured by covering the incidence plane and the emission plane with fine metal mesh having a high open area ratio, if necessary.

The apparatus is designed so that the vacuum chamber wall separating the ion trap and the TOF mass spectrometer is located in a subsequent stage of the acceleration region. In other words, the ion trap, the acceleration region, the vacuum chamber wall and the drift region, (the quadrupole static lens, if necessary), and the pusher are arranged in this order.

As one of the embodiments of ejecting heavy ions earlier than light ions according to the present invention, there is an operating method in which the ion trap high-frequency voltage is fixed with a gradual increase of the electrostatic voltage $V_{ddc}$. In other words, the electrostatic voltage $V_{ddc}$ is applied to the extent that ions are ejected in the $t_{dc}$ portion in FIG. 2. In this condition, as apparent from (Eq. 9), a time function for sweeping $V_{ddc}$ is put in proportion to the ½ power of the time period from the start of the increase. This method involves large micromotion (a forced oscillation due to the RF) kinetic energy generated by ejecting ions at an intensive RF voltage, thereby broadening the ion energy distribution in the z direction, which results in an adverse effect on the sensitivity or the resolution. It, however, is useful to detect ions having high mass numbers ejected from the ion trap in $t_{dc}$ before the high-frequency amplitude decreases simultaneously with ions ejected in $t_{scan}$ in FIG. 2.

Figure 12:
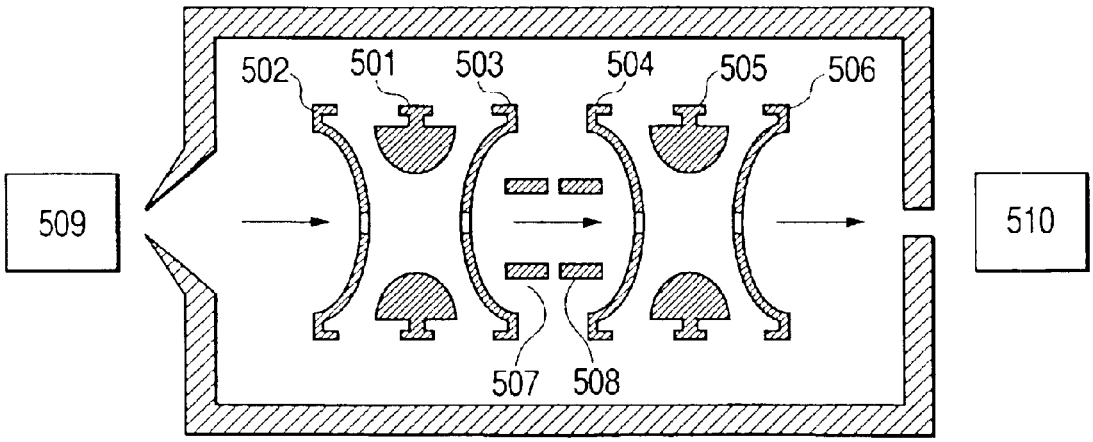
FIG. 12 is an explanatory diagram schematically showing a configuration of an apparatus according to a third embodiment of the present invention.

While all of the above embodiments are described on the assumption that the initial electric potential of the pusher is 0 V, the same effect is achieved by shifting potentials in other sites in parallel correspondingly unless the potential of the pusher is 0 V. The above embodiments have been described in a case where the present invention is applied to an IT-TOF apparatus. A more advanced IT-TOF apparatus can be conceived by utilizing the advantage that low-energy ions can be ejected from the ion trap according to the present invention. As this example, a third embodiment will now be described by using FIG. 12. FIG. 12 shows a diagram of two quadrupole ion traps arranged with the same electrode arrangement as one conventionally suggested by Reinhold et al. (PCT patent WO 01/15201A2). According to this, ions generated by the ion source are stored in the first ion trap (501, 502, and 503). Thereafter, the ions are moved to the second ion trap (504, 505, and 506) and then introduced into a time-of-flight mass spectrometer for a multistage mass spectrometry, as disclosed in the diagram. Its effective voltage application method was not described, and the transport between the ion traps has not come into practical use. As an object for its practical application, there is an improvement of the transport efficiency between the ion traps. In the conventional ion ejection method, the energy of ions ejected from the first ion trap is uneven and therefore the transport efficiency between the traps is low. In other words, ions of respective mass numbers are ejected in the state shown in FIG. 4A and the ions are ejected at potentials different with respect to each mass number. In other words, the ions have energies different with respect to each mass number and therefore a focusing optical system of the ejected ions have a large energy aberration, by which the transmittance becomes low. Therefore, in order to cause the ions to be incident on the second ion trap at a high efficiency, a high acceleration voltage is needed. The high acceleration voltage, however, On the other hand, as apparent from FIGS. 4A–4C, according to the ion ejection method of the present invention, the respective ions are ejected at the same potential independently of the mass numbers and the ions can be ejected at almost the same energy from the ion trap, by which the ejected ions have almost the same energy distribution independently of the mass numbers. Accordingly, there is no chromatic aberration of the ion optical system, thereby improving the transport efficiency between the ion traps. In this embodiment, ions generated by the ion source are stored in the first ion trap (501, 502, and 503) and then the ions are moved to the second ion trap (504, 505, and 506) by using the ion ejection method of the present invention. After an ion control such as the ion dissociation in the second ion trap, a mass spectrometry is performed by using the TOFMS (510). An electrostatic voltage for focusing the ions on the second endcap electrode hole is applied to the static lens. While the ion control is performed in the second ion trap, ions are stored in the first ion trap, thereby improving the entire ion usability. Furthermore, there is no need for spatially focusing ions having different mass numbers in the ion transport between the ion traps of this embodiment and therefore the amplitude need not be decreased linearly as in the first and second embodiments. On the other hand, the performed in the same manner as in the methods of the first and second embodiments. Although only two ion traps are used in the diagram, it is possible to achieve the same effect of improving the transport efficiency between the ion traps according to the present invention also when installing three or more ion traps in tandem.

Furthermore, it is also possible to connect a Fourier transform mass spectrometer instead of the time-of-flight mass spectrometer as the mass analyzer by utilizing the ion ejection at low energy. In this condition, after performing the ion decomposition in the ion trap, ions are introduced to the Fourier transform mass spectrometer to which a magnetic field is applied, which increases the ion incidence efficiency and therefore improves the sensitivity.

As an effect accompanying the present invention, a problem related to a high-pressure bath gas in the ion trap is resolved. In the conventional method, ions are accelerated to move at a finite speed inside the ion trap in which the vacuum is low and therefore ions tend to be ejected from the ion trap later than a given timing due to a collision with gas or due to a viscous drag. In the present invention, ions are not accelerated inside the ion trap in which the vacuum is high, but they are accelerated in a region in which the vacuum is low after they are ejected from the ion trap, by which this problem is resolved.

According to the present invention, ions in a wide mass range obtained by a protein analysis can be analyzed at a high mass accuracy with a single TOF mass spectrometry operation. This enables a fast protein structure analysis.

It should be further understood by those skilled in the art that although the foregoing description has been made on embodiments of the invention, the invention is not limited thereto and various changes and modifications may be made without departing from the spirit of the invention and the scope of the appended claims.

Description of Reference Numerals

1 Ring electrode,
2 Endcap electrode (Inlet),
3 Endcap electrode (Outlet),
4 Helium gas inlet,
5 Drift region,
6 TOF pusher,
7 Reflectron,
8 Multichannel plate,
9 High-frequency power supply for ion trap,
10 DC power supply,
11 DC power supply,
12 DC power supply,
13 Quadrupole static lens,
14 Vacuum pump,
15 Vacuum pump,
16 Ion source,
301 Ring electrode,
302 Endcap electrode (Inlet),

303 Endcap electrode (Outlet),
304 Helium gas inlet,
305 Acceleration region,
306 TOF pusher,
307 Reflectron,
308 Multichannel plate,
309 High-frequency power supply for ion trap,
310 DC power supply,
311 DC power supply,
312 DC power supply,
313 Quadrupole static lens,
501 Ring electrode of the first ion trap,
502 Endcap electrode of the first ion trap (Inlet),
503 Endcap electrode of the first ion trap (Outlet),
504 Ring electrode of the second ion trap,
505 Endcap electrode of the second ion trap (Inlet),
506 Endcap electrode of the second ion trap (Outlet),
507 Static lens,
508 Static lens,
509 Ion source,
510 Mass analyzer.

What is claimed is:

1. A mass spectrometer having a 3-D quadrupole ion trap comprising a ring electrode and a pair of endcap electrodes opposed to each other, wherein an electrostatic voltage is supplied between said endcap electrodes, and a high-frequency voltage is supplied to said ring electrode and is swept from a large amplitude to a small amplitude, and wherein the electrostatic voltage between said endcap electrodes is increased to a given value overtime of 0.1 ms or longer.

2. A mass spectrometer having a 3-D quadrupole ion trap comprising a ring electrode and a pair of endcap electrodes opposed to each other, wherein an electrostatic voltage is supplied between said endcap electrodes, and a high-frequency voltage is supplied to said ring electrode and is swept from a large amplitude to a small amplitude, wherein the electrostatic voltage between said endcap electrodes is increased to a given value over time of 0.1 ms or longer, and wherein the electrostatic voltage is in proportion to the ½ power of the time period from the start of an increase of the electrostatic voltage.

3. The mass spectrometer according to claim 1, wherein the electrostatic voltage is supplied between said endcap electrodes, and the high-frequency voltage is supplied to said ring electrode and swept from the larger amplitude to the small amplitude so as to sequentially eject ions from the 3-D quadrupole ion trap in descending order of mass of the ions.

4. The mass spectrometer according to claim 2, wherein the electrostatic voltage is supplied between said endcap electrodes, and the high-frequency voltage is supplied to said ring electrode and swept from the larger amplitude to the small amplitude so as to sequentially eject ions from the 3-D quadrupole ion trap in descending order of mass of the ions.

* * * * *